US008257896B2

(12) United States Patent
Masuda et al.

(10) Patent No.: US 8,257,896 B2
(45) Date of Patent: Sep. 4, 2012

(54) CARRIER

(75) Inventors: Minoru Masuda, Numazu (JP); Kimitoshi Yamaguchi, Numazu (JP); Yutaka Takahashi, Yokohama (JP); Koichi Sakata, Shizuoka (JP); Hitoshi Iwatsuki, Numazu (JP); Toyoaki Tano, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 177 days.

(21) Appl. No.: 12/720,958

(22) Filed: Mar. 10, 2010

(65) Prior Publication Data

US 2010/0233613 A1 Sep. 16, 2010

(30) Foreign Application Priority Data

Mar. 12, 2009 (JP) ..... 2009-058911
Mar. 3, 2010 (JP) ..... 2010-046615

(51) Int. Cl.
*G03G 9/00* (2006.01)

(52) U.S. Cl. ..... 430/111.35; 430/111.1; 430/111.3; 430/111.31; 430/111.32

(58) Field of Classification Search ..... 430/111.1, 430/111.3, 111.31, 111.32, 111.35
See application file for complete search history.

(56) References Cited

U.S. PATENT DOCUMENTS 6,106,987 A * 8/2000 Hakata et al. ..... 430/111.35
6,331,373 B1 * 12/2001 Kuramoto et al. ..... 430/108.2
6,828,075 B2 12/2004 Suzuki et al.
6,939,654 B2 9/2005 Kotsugai et al.
7,381,513 B2 6/2008 Suzuki et al.
7,592,116 B2 9/2009 Suzuki et al.

FOREIGN PATENT DOCUMENTS

| | | |
|---|---|---|
| EP | 0 973 070 A1 | 1/2000 |
| EP | 0 989 467 A2 | 3/2000 |
| EP | 0 989 467 A3 | 3/2000 |
| JP | 6-222621 | 8/1994 |
| JP | 2001-92189 | 4/2001 |
| JP | 2006-337828 | 12/2006 |
| JP | 3933498 | 3/2007 |

OTHER PUBLICATIONS

Extended European Search Report issued Jul. 23, 2010 in EP 10 15 6214.
U.S. Appl. No. 12/714,848, filed Mar. 1, 2010, Yamaguchi, et al.

* cited by examiner

*Primary Examiner* — Mark F Huff
*Assistant Examiner* — Stewart Fraser
(74) *Attorney, Agent, or Firm* — Oblon, Spivak, McClelland, Maier & Neustadt, L.L.P.

(57) ABSTRACT

A carrier which is capable of avoiding excess blocking of the carrier particles at the time of forming a covering layer and is excellent in durability, a developer containing the carrier, and a developer container containing the developer, as well as an image forming method and a process cartridge which use the developer are provided. A carrier including at least a core material particle and a covering layer, a surface of the core material particle being covered with the covering layer, wherein the covering layer contains a condensate which is obtained by condensation of a silicone resin having at least one of a silanol group and a functional group which can be converted to the silanol group by hydrolysis, using a titanium diisopropoxy bis(ethylaceto-acetate) catalyst.

13 Claims, 2 Drawing Sheets

CARRIER

BACKGROUND OF THE INVENTION

1. Field of the Invention

The present invention relates to a carrier having a core material particle, a surface of the core material particle being covered with a covering layer.

2. Description of the Related Art

In image formation by an electrophotographic method, latent electrostatic images are formed on a latent electrostatic image bearing member such as those made of a photoconductive material, toner images are formed by making charged toners adhere to these latent electrostatic images, and then the resulting toner images are transferred to a recording medium, and fixed to form output images. In recent years, technologies such as copiers and printers using electrophotographic methods are gradually developing from those using monochromatic electrophotographic methods to those using full-color electrophotographic methods, and the rate of development is increasing. Thus, the market for technologies using full-color electrophotographic methods is increasing.

In full-color image formation, generally, three color toners of yellow, magenta, and cyan, or four color toners of black as well as yellow, magenta, and cyan are laminated to reproduce all colors. Thus, in order to obtain a sharp full-color image excellent in color-reproducibility, it is necessary to smooth the surface of a fixed toner image so as to reduce light scattering. Accordingly, image gloss obtained by means of conventional full-color copiers, and the like, is often middle to high, that is, 10% to 50%.

Generally, as a method of fixing a dry-toner image on a recording medium, the contact-heating fixing method is often employed in which a roller or belt having a smooth surface is press-contact with toner while heating the roller or belt. This method has advantages in that it exhibits high-thermal efficiency, enables high-speed fixing and enables toners used in polychromatic image formation to have glossiness and transparency. On the other hand, this method inconveniently causes a so-called offset phenomenon in which a part of a toner image adheres to the surface of a fixing roller and then transferred onto another image, because a surface of a heat-fixing member is made in contact with a molten toner under application of pressure and then they separates from each other.

With a view to preventing the offset phenomenon, there has been carried out a method of forming a surface layer of a fixing roller with use of a material excellent in releasing property, such as a silicone rubber and a fluorine resin, and further applying a toner adhesion preventing oil, such as a silicone oil, onto the surface layer of the fixing roller. Although this method is extremely effective in preventing toner-offset, this method requires additionally providing a device for supplying the oil, leading to upsizing of the fixing device.

As a result, in monochromatic image formation, an oil-less system in which a toner, which has a high viscoelasticity at the time of melting and contains a releasing agent in order to avoid internal fracture of the molten toner, is used to dispense with oil application onto a fixing roller, or a system in which the toner is used to make the application amount of oil very small is increasingly used.

Meanwhile, also in full-color image formation, an oil-less system tends to be employed for downsizing of a fixing device and simplification of the structure as well as in monochromatic image formation. However, in full-color image formation there is a need to smooth the surface of a fixed toner image, and thus to reduce the viscoelasticity of the toner in a molten state. Therefore, the full-color image formation can more easily cause the offset phenomenon than the monochromatic image formation, which produces less glossiness, and the full-color image formation becomes more difficult to employ the oil-less system. When a releasing agent is incorporated into a toner, the adhesive strength of the toner is increased, so that the transferability of the toner to a recording medium is degraded. Further, the incorporation of the releasing agent into a toner disadvantageously causes toner filming, leading to degradation in chargeability and then in durability.

Meanwhile, a carrier, a surface of which is coated with a silicone resin, is known as being a carrier designed to meet objectives, such as to prevent toner filming, form a uniform surface, prevent surface oxidation and degradation of moisture sensitivity, extend a lifetime of a developer, prevent adhesion onto the surface of a photoconductor, protect the photoconductor from being scratched and wearing, control charge polarity, and adjust the charge amount.

Conventionally known in the art is a carrier composed of at least a carrier core material particle, a surface of which being covered with a covering layer produced by a condensation using a titanium catalyst between (i) a polysiloxane material and (ii) a coating liquid containing a siloxane-based material having one of a silanol group and a precursor group thereof (e.g., a hydrolysable group, such as a halosilyl group and an alkoxysilyl group) which is capable of undergoing the condensation. For example, Japanese Patent Application Laid-Open (JP-A) No. 2001-92189 discloses a carrier composed of at least a core material particle, a surface of which is coated with a silicone resin containing an organic titanium-based catalyst, and lists for an example of titanium-based catalyst diisopropoxy bis(acetyl acetonate) titanium (described herein in Comparative Example 2) as a chemical which has the same effect as tetraisopropoxy titanium (described herein in Comparative Example 1), isopropoxy (2-ethyl hexanediolato) titanium, bis(acryloyloxy) isopropoxy isostearoyloxy titanium, bis(2,4-pentadionato) (1,3-propanedionato) titanium, or the like. JP-A No. 06-222621 discloses a carrier composed of at least a core material particle, a surface of which is coated with a coating agent having as a main component a coating composition consisting of at least an organopolysiloxane, organosilane, and a curing catalyst which is at least one selected from the group consisting of titanium (for example, the above mentioned tetraisopropoxy titanium), tin (for example, dibutyl tin diacetate as described herein in Comparative Example 3), zinc, cobalt, iron, an aluminum-based compound, and amines. Furthermore, JP-A No. 2006-337828 discloses a carrier composed of at least a core material particle, a surface of which is coated with one of a silicone resin and a modified silicone resin which contains at least a quaternary ammonium salt catalyst, an aluminum catalyst, or a titanium catalyst (specifically the above-mentioned diisopropoxy bis(acetyl acetonate) titanium).

However, these carriers disadvantageously cause blocking therewithin at the time of forming a covering layer, and the durability thereof is degraded.

BRIEF SUMMARY OF THE INVENTION

A purpose of the present invention is to solve the above-mentioned problems of the conventional art and to achieve the following objects. Namely, the objects of the present invention is to provide a carrier which is capable of avoiding excess blocking of the carrier particles at the time of forming a covering layer and is excellent in durability, a developer containing the carrier, and a developer container containing the developer, as well as an image forming method and a process cartridge which use the developer.

Means for solving the above problems are as follows:

<1> A carrier including at least a core material particle, and a covering layer, a surface of the core material particle being covered with the covering layer, the covering layer contains a condensate which is produced by condensation of a silicone resin having at least one of a silanol group and a functional group which can be converted to the silanol group by hydrolysis, the condensation caused by titanium diisopropoxy bis (ethylaceto-acetate) which is incorporated in the silicone resin.

<2> The carrier according to <1>, wherein the silicone resin is cured by a crosslinking agent represented by the following formula:

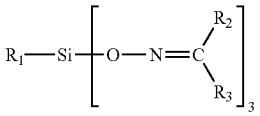

wherein $R_1$, $R_2$, and $R_3$ each represent one of $CH_3$ and $C_2H_5$.

<3> The carrier according to one of <1> and <2>, wherein the amount of titanium diisopropoxy bis(ethylaceto-acetate) is 0.5 parts by mass to 20 parts by mass per 100 parts by mass of the silicone resin and the crosslinking agent.

<4> The carrier according to any one of <1> to <3>, wherein the covering layer further contains a conductive particle.

<5> The carrier according to one of <1> and <4>, wherein the covering layer further contains a silane coupling agent.

<6> The carrier according to any one of <1> to <5>, wherein the covering layer further contains an acrylic resin.

<7> The carrier according to any one of <1> to <6>, wherein the carrier has a specific volume resistance of $1\times10^9\Omega\cdot$cm to $1\times10^{17}\Omega\cdot$cm.

<8> The carrier according to any one of <1> to <7>, wherein the covering layer has an average thickness of 0.05 μm to 4 μm.

<9> The carrier according to any one of <1> to <8>, wherein the core material particle has a weight average particle diameter of 20 μm to 65 μm.

<10> The carrier according to any one of <1> to <9>, wherein the magnetization of the carrier in a magnetic field of 1 kOe is 40 $Am^2$/kg to 90 $Am^2$/kg.

<11> A developer including at least the carrier according to any one of <1> to <10>, and a toner.

<12> The developer according to <11>, wherein the toner is a color toner.

<13> A method for producing a carrier, including at least subjecting condensation a silicone resin having at least one of a silanol group and a functional group which can be converted to the silanol group by hydrolysis, using titanium diisopropoxy bis(ethylaceto-acetate).

<14> The method for producing a carrier according to <13>, further including at least a cross-linking reaction caused by addition of a crosslinking agent before the condensation.

<15> A developer container including at least the developer according to any one of <11> and <12> therein.

<16> An image forming method including at least forming a latent electrostatic image on a latent electrostatic image bearing member, developing the latent electrostatic image formed on the latent electrostatic image bearing member with the developer according to one of <11> and <12> to form a toner image, transferring the toner image formed on the latent electrostatic image bearing member to a recording medium, and fixing the toner image transferred onto the recording medium.

<17> A process cartridge including at least a latent electrostatic image bearing member, and a unit configured to develop a latent electrostatic image formed on the latent electrostatic image bearing member with the developer according to one of <11> and <12>, wherein the latent electrostatic image bearing member and the unit are at least mounted on the process cartridge in an integrated manner.

<18> A supplemental developer containing at least a toner in a mixing ratio of 2 parts by mass to 50 parts by mass per one part by mass of a carrier, wherein the carrier is a carrier according to any one of <1> to <10>.

According to the present invention, it is possible to solve the problems of the conventional art, achieve the above-mentioned objectives, and provide a carrier which is capable of evading excess blocking of the carrier particles at the time of forming a covering layer and is excellent in durability, a developer containing the carrier, and a developer container containing the developer, as well as an image forming method and a process cartridge which use the developer.

DETAILED DESCRIPTION OF THE INVENTION

Figure 1:
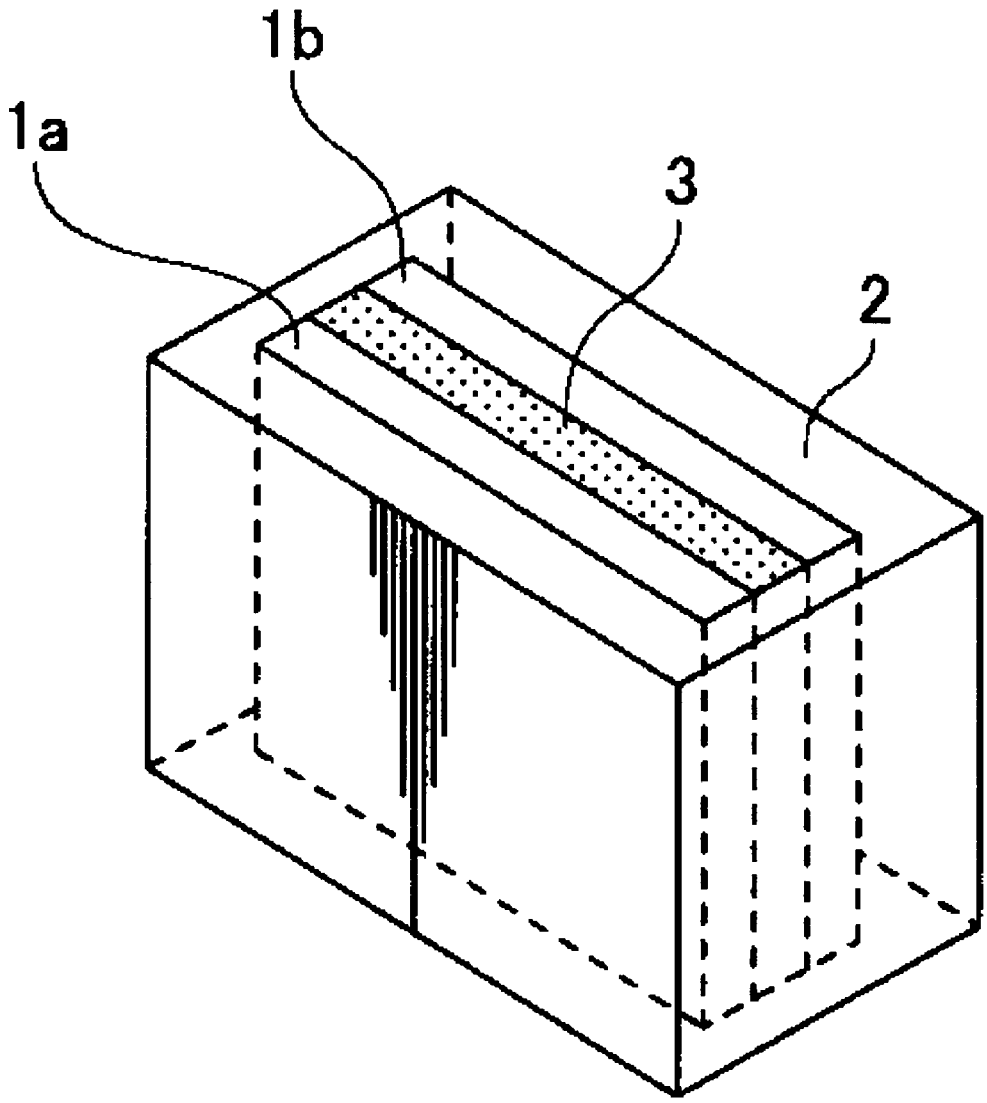
FIG. 1 is a view of a cell used in measurement of the specific volume resistance of a carrier of the present invention.

Hereinafter, the best mode for carrying out the present invention will be described with reference to the drawings.

In a carrier of the present invention, a covering layer is formed on a surface of a core material particle, and the covering layer contains a cross-linked product obtained by condensation, using titanium diisopropoxy bis(ethylaceto-acetate), of a silicone resin having at least one of a silanol group and a functional group which can be converted to the silanol group by hydrolysis (hereinafter referred to as a hydrolysable functional group). Accordingly, it is possible for the silanol group to undergo the condensation in such an adequate manner that the blocking of the carrier particles may be reduced at the time of formation of the covering layer. In addition, the adequate condensation of the silanol group may result in a covering layer which is excellent in binding ability with the core material particle and has a low surface energy and a low adhering ability to outside, leading to reduction of toner filming. Furthermore, the condensation of the silanol group may result in siloxane bonding, leading to increase in molecular weight of the silicone resin and thus strength of the covering layer. In this case, if the number of the silanol group and the hydrolysable functional group has been increased per silicon atom of the silicone resin, it is possible to increase the crosslinking density and thus the hardness of the covering layer.

Such a silicone resin is not particularly limited, as far as it has at least one of a silanol group and a hydrolysable functional group, and may be used in combination. The hydrolysable functional group is not particularly limited, and is, for example, a halosilyl group, an alkoxysilyl group, a hydrosilyl group, an isocyanatesilyl group, and a ketoxime group. These may be used alone or in combination.

Commercial products of a silicone resin having at least one of the silanol group and the hydrolysable functional group are not particularly limited, and are, for example, KR155, KR282, KR211, KR216, and KR213 (manufactured by Shin-Etsu Chemical Co., Ltd); AY42-170, SR2510, SR2406, SR2410, SR2405, SR2411, and SR2400 (manufactured by Dow Corning Toray Co., Ltd.).

Examples of the catalyst include titanium-based catalysts, tin-based catalysts, zirconium-based catalysts, and aluminum-based catalysts. The present invention is achieved, based on findings that especially titanium diisopropoxy bis(ethylaceto-acetate) produces the most preferable result as a catalyst among the titanium-based catalysts which produce excellent results in the above mentioned catalysts, because that titanium diisopropoxy bis(ethylaceto-acetate) may greatly enhance the condensation of the silanol group and may be difficult to be inactivated. The titanium diisopropoxy bis (ethylaceto-acetate) has the following chemical formula:

$$Ti(O\text{-}i\text{-}C_3H_7)_2(C_6H_9O_3)_2$$

In the present invention, preferably a silicone resin composition is cured, which is produced by adding a crosslinking agent having the following general formula to the silicone resin having at least one of the silanol group and the hydrolysable functional group.

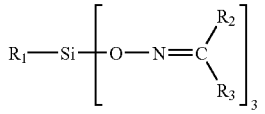

wherein $R_1$, $R_2$, and $R_3$ each represent one of $CH_3$ and $C_2H_5$.

The above crosslinking agent is an oxime type crosslinking agent, and is excellent in storage stability and capable of appropriately controlling residual SiOH groups in the silicone resin. Specific examples of the above crosslinking agent include a compound represented by the following chemical formula:

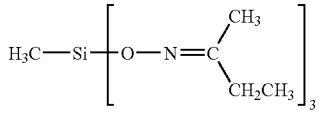

The amount of the crosslinking agent added is preferably 0 parts by mass to 100 parts by mass per 100 parts by mass of the silicone resin.

When the amount of the crosslinking agent added is more than 100 parts by mass per 100 parts by mass of the silicone resin, the relative amount of the crosslinking agent to the silicone resin becomes excessively large, leading to reduction of film strength. Note that, if the silicone resin is highly reactive, it is not always necessary to add the present crosslinking agent to the silicone resin.

On the one hand, the titanium diisopropoxy bis(ethylaceto-acetate) serves as a catalyst for a silicone resin having at least one of a silanol group and a hydrolysable functional group, however, it also serves as a monomer. When the titanium diisopropoxy bis(ethylaceto-acetate) serves as a monomer, it is incorporated into the silicone resin. Therefore, in this case, it is possible to increase the amount thereof. When the titanium diisopropoxy bis(ethylaceto-acetate) serves as a catalyst not as the monomer, it remains singly as the catalyst in the silicone resin. Therefore when the amount of the titanium diisopropoxy bis(ethylaceto-acetate) is increased, a large amount of the catalyst disadvantageously remains in the silicone resin.

For example, when the catalyst is in liquid form, the carrier becomes sticky and increases the surface energy thereof, leading to increase of carrier spent.

On the other hand, such a problem as mentioned above can be avoided in the case of a carrier using titanium diisopropoxy bis(ethylaceto-acetate) which is used in the present invention, even when the amount of the catalyst is increased, because titanium diisopropoxy bis(ethylaceto-acetate) is incorporated into the silicone resin.

The amount of the titanium diisopropoxy bis(ethylaceto-acetate) is preferably 0.5 parts by mass to 20 parts by mass, and more preferably 2 parts by mass to 15 parts by mass, relative to 100 parts by mass of a composition of the silicone resin having at least one of a silanol group and a hydrolysable functional group, and the crosslinking agent. When the amount of the titanium diisopropoxy bis(ethylaceto-acetate) is less than 0.5 parts by mass, the condensation does not proceed because the amount of the titanium diisopropoxy bis(ethylaceto-acetate) as a catalyst is insufficient, leading to some problems at the time of coating and sintering of the carrier. When the amount of the titanium diisopropoxy bis (ethylaceto-acetate) is more than 20 parts by mass, the portion of titanium diisopropoxy bis(ethylaceto-acetate) which is not incorporated into the silicone resin as monomers increases, and, thus, a large amount of a low-molecular weight titanium compound remains, leading to concern about increase in stickiness and surface energy of the carrier and about degradation in strength of the coating film.

Note that the covering layer can be formed with a covering layer composition containing the silicone resin having at least one of the silanol group and the hydrolysable functional group, titanium diisopropoxy bis(ethylaceto-acetate), and, if necessary, a resin other than the silicone resin having at least one of the silanol group and the hydrolysable functional group, and a solvent. Specifically, the covering layer may be formed by the condensation of the silanol group, while coating the core material particle with the covering layer composition, or the covering layer may be formed by the condensation of the silanol group after the core material particle has been coated with the covering layer composition.

A method of condensation of the silanol group while coating the core material particle with the covering layer composition is not particularly limited, and is, for example, a method of coating the core material particle with the covering layer composition, while applying heat or light to the covering layer composition.

Also, a method of condensation of the silanol group after the core material particle has been coated with the covering layer composition is not particularly limited, and is, for example, a method of heating the covering layer after the core material particle has been coated with the covering layer composition.

Examples of the resins other than the silicone resins having at least one of the silanol group and the hydrolysable functional group are not particularly limited, and are, for example, acrylic resins, amino resins, polyvinyl-based resins, polystyrene-based resins, halogenated olefin resins, polyester, polycarbonate, polyethylene, polyvinyl fluoride, polyvinylidene fluoride, polytrifluoroethylene, polyhexafluoropropylene, copolymers of vinylidene fluoride and vinyl fluoride, fluoroterpolymers, such as terpolymers of tetrafluoroethylene, vinylidene fluoride, and a nonfluoride monomer, and silicone resins which have neither silanol group nor hydrolysable functional group. These may be used alone or in combination. Among these, acrylic resins are preferable from the view point of strong binding ability between the core material particle and the conductive particle, and of low fragility.

The acrylic resin preferably has a glass transition temperature of 20° C. to 100° C., and more preferably of 25° C. to 80° C. Because the acrylic resin has moderate elasticity, it can absorb impacts and maintain the covering layer without damage, when strong impacts are imposed on the covering layer by friction between the toner and the carrier or between carriers at the time of friction-charging of a developer.

In addition, the covering layer further preferably contains a cross-link product of an acrylic resin and an amino resin. Herewith, it is possible to prevent the covering layers from fusing, while maintaining appropriate elasticity.

The amino resins are not particularly limited, and are preferably melamine resins and benzoguanamine resins, because they can improve charging ability of the carrier. Further, when it is necessary to appropriately control the charging ability of the carrier, the melamine resins and the benzoguanamine resins may be used in combination with at least any one of other than the two.

Acrylic resins which can be cross-linked with the amino resins are preferably those having at least one of a hydroxyl group and a carboxyl group, and more preferably those having a hydroxyl group. Providing these groups for acrylic resins may further improves the binding ability of the acrylic resins with core material particles and conductive particles, and may improve dispersion stability of the conductive particles. In this case, the acrylic resins preferably have a hydroxyl group value of 10 mgKOH/g or more, and further preferably 20 mgKOH/g or more.

In the present invention, the covering layer composition preferably contains a conductive particle. Using the conductive particle, the specific volume resistance (specific electrical resistance) of the carrier may be adjusted. The conductive particle is not particularly limited, and is, for example, carbon black, ITO, tin oxide, and zinc oxide. These may be used alone or in combination.

The amount of the conductive particle added is preferably 0.1% by mass to 1,000% by mass relative to the amount of the silicone resin.

When the amount of the conductive particle added is less than 0.1% by mass, the carrier's effects of adjusting the specific volume resistance may become inadequate. When the amount of the fine conductive particle is more than 1,000% by mass, it becomes difficult to maintain the fine conductive particle and becomes easy for the surface layer of the carrier to be destroyed.

In the present invention, the covering layer composition preferably contains a silane coupling agent. Using the silane coupling agent in the covering layer composition may make the conductive particle stably disperse.

The silane coupling agent is not particularly limited, and is, for example, γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzilaminoethyl)-γ-aminopropyltrimethoxysilane hydrochloride, γ-glycidoxypropyltrimethoxysilane, γ-mercaptopropyltrimethoxysilane, methyltrimethoxysilane, methyltriethoysilane, vinyltriacetoxysilane, γ-chloropropyltrimethoxysilane, hexamethyldisilazane, γ-anilinopropyltrimethoxysilane, vinyltrimethoxysilane, octadecyldimethyl [3-(trimethoxysilyl)propyl.]ammonium chloride, γ-chlorpropylmethyldimethoxysilane, methyltrichlorosilane, dimethyldichlorosilane, trimethylchlorosilane, trimethyldchlorosilane, allyltriethoxysilane, 3-aminopropylmethyldiethoxysilane, 3-aminopropyltrimethoxysilane, dimethyldiethoxysilane, 1,3-divinyltetramethyldisilazane, and methacryloxyethyldimethyl (3-trimethoxysilylpropyl)ammonium chloride. These may be used alone or in combination.

Examples of commercial products of the silane coupling agents include AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (manufactured by Dow Corning Toray, Co., Ltd.).

The amount of the silane coupling agent added is preferably 0.1% by mass to 10% by mass relative to the amount of the silicone resin.

When the amount of the silane coupling agent added is less than 0.1% by mass, the binding ability of the core material particle or the conductive particle with the silicone resin may be reduced, leading to separation of the covering layer during long-term use thereof. When the amount of the silane coupling agent added is more than 10% by mass, toner filming may occur during long-term use thereof.

In the present invention, the average thickness of the covering layer is preferably 0.05 μm to 4 μm.

When the average thickness is less than 0.05 μm, the covering layer becomes easy to be broken and the film may be scraped. When the average thickness is more than 4 μm, the carrier becomes easy to bind with image parts because the covering layer is not a magnetic body.

In the present invention, the core material particle is not particularly limited, as long as it is a magnetic body; examples thereof include a ferromagnetic metal, iron oxide, various alloys and compounds, and resin particles produced by dispersing the magnetic bodies in a resin. Among these magnetic bodies, magnetic bodies such as Mn ferrite, Mn—Mg ferrite, and Mn—Mg—Sr ferrite are preferable from the view point of environmental care.

Examples of the ferromagnetic metal include iron, and cobalt.

Examples of the iron oxide include magnetite, hematite, and ferrite.

The weight average particle diameter of the core material particles is preferably 20 μm to 65 μm. When the weight average particle diameter of the core material particles is less than 20 μm, the carrier may binds with each other. When the weight average particle diameter is more than 65 μm, the reproducibility of minute parts of the images may be degraded and fine images may not be formed.

Note that the weight average particle diameter may be measured with Microtrac Particle Size Analyzer (Model HRA9320-X100, manufactured by NIKKISO CO., Ltd).

In addition, the magnetization of the carrier of the present invention in a magnetic field of 1 kOe ($10^6/4\pi$[A/m]) is preferably 40 $Am^2/kg$ to 90 $Am^2/kg$.

When the magnetization is less than 40 $Am^2/kg$, the carrier may adhere to images. When the magnetization is more than 90 $Am^2/kg$, or magnetic ears become hard, which may produce scratchy images.

Note that the magnetization can be measured using VSM-P7-15 (manufactured by TOEI INDUSTRY CO., LTD.).

The specific volume resistance of the carrier is preferably $1\times10^9\Omega\cdot cm$ to $1\times10^{17}\Omega\cdot cm$.

When the specific volume resistance of the carrier is lower than $1\times10^9\Omega\cdot cm$, the carrier may be adhere to a non-image portion. When the specific volume resistance is higher than $1\times10^{17}\Omega\cdot$cm, the edge effect on images may become intolerable.

Note that the specific volume resistance may be measured using a cell exhibited in FIG. 1. Specifically, a procedure for the measurement is as follows: a cell composed of a fluorine resin container (2) containing a first electrode (1*a*) and a second electrode (1*b*) each having a surface area of 2.5 cm×4 cm and separated by a distance of 0.2 cm is charged with a carrier (3), and then the cell charged with the carrier is tapped on a substrate ten times from a falling height of 1 cm at a tapping rate of 30 times/min. Subsequently, a DC voltage of 1,000 V is applied between the first electrode (1*a*) and the second electrode (1*b*), and 30 sec after the voltage application, the resistance value r [Ω] is measured using a HIGH RESISTANCE METER 4329A (manufactured by Yokogawa Hewlett-Packard), and based on the resistance value the specific volume resistance [Ω·cm] can be calculated in accordance with the following formula.

$$r\times(2.5\times4)/0.2$$

(Developer)

A developer of the present invention contains the carrier of the present invention and a toner.

The toner may contain a binder resin and a colorant, and may be a toner used in monochromatic image formation or in polychromatic image formation. Furthermore, when the toner is to be used in an oilless system in which a toner adhesion preventing oil is not applied on a fixing roller, the toner may contain a releasing agent. Generally, such a toner tends to cause filming, however the carrier of the present invention can prevent the filming and thus the developer of the present invention can maintain its excellent quality over a long time period. Furthermore, a toner used in polychromatic image formation, especially a toner having a yellow color, generally, disadvantageously produces color contamination due to scraping of the covering layer of the carrier. However, the developer of the present invention may reduce the color contamination.

The toner may be produced by a known method such as pulverization and polymerization. For example, the procedure for producing the toner by pulverization is as follows. First, a toner material is kneaded to produce melt-kneaded matter, the melt-kneaded matter is cooled, and pulverized, and then the pulverulent matter is classified to produce base particles. Subsequently, in order further to improve transferability and durability of the base particles, an external additive is added to the base particles to produce a toner.

In this case, the kneading device for kneading the toner materials is not particularly limited; examples thereof include a batch type two roll mill; a Banbury Mixer; a continuous biaxial extruder such as a KTK type biaxial extruder (manufactured by Kobe Steel, Ltd.), a TEM type biaxial extruder (manufactured by Toshiba Machine Co., Ltd), a biaxial extruder (manufactured by KCK), a PCM type biaxial extruder (manufactured by Ikegai Co. Ltd.), a KEX type biaxial extruder (manufactured by Kurimoto, Ltd.); and a continuous monoaxial extruder such as a Ko-kneader (manufactured by Bus).

Furthermore, for pulverization of the cooled melt-kneaded matter, the cooled melt-kneaded matter may be coarsely pulverized with a hammer mill, a Rotoplex, and the like, and then finely pulverized with a pulverizing mill and a machine type pulverizing mill which use a jet stream. Note that the cooled melt-kneaded matter is preferably pulverized such that the resulting pulverulent particles have an average particle diameter of 3 μm to 15 μm.

In addition, for the classification of the pulverized melt-kneaded matter, a wind classifier, and the like, can be used. Note that the pulverized melt-kneaded matter is preferably pulverized such that the resulting base particles have an average particle diameter of 5 μm to 20 μm.

Furthermore, for the addition of the external additive to the base particles, the external additive is incorporated into and stirred in the base particles using a mixer, and pulverized/disintegrated and made adhere to the surface of the base particles.

The binder resin is not particularly limited; examples thereof include homopolymers of styrene or a substitution product thereof, styrene-based copolymers, polymethylmethacrylate, polybutylmethacrylate, polyvinylchloride, polyvinylacetate, polyethylene, polyester, polyurethane, epoxy resins, polyvinyl butyral, polyacrylic acid, rosin, modified rosins, terpene resins, phenol resins, aliphatic/aromatic hydrocarbon resins, and aromatic petroleum resins. These may be used alone or in combination.

Examples of the homopolymers of styrene or a substitution product thereof include polystyrene, poly(p-styrene), and polyvinyltoluene.

Examples of the styrene-based copolymers include styrene/p-chlorostyrene copolymers, styrene/propylene copolymers, styrene/vinyl toluene copolymers, styrene/methyl acrylate copolymers, styrene/ethyl acrylate copolymers, styrene/methacrylic acid copolymers, styrene/methyl methacrylate copolymers, styrene/ethyl methacrylate copolymers, styrene/butyl methacrylate copolymers, styrene/methyl α-chloromethacrylate copolymers, styrene/acrylonitrile copolymers, styrene/vinyl methyl ether copolymers, styrene/vinyl methyl ketone copolymers, styrene/butadiene copolymers, styrene/isoprene copolymers, and styrene/maleic acid ester copolymers.

The binder resin for pressure fixing is not particularly limited; examples thereof include polyolefin, olefin copolymers, epoxy resins, polyester, styrene/butadiene copolymers, polyvinylpyrrolidone, methyl vinyl ether/maleic anhydride copolymers, maleic acid-modified phenol resins, and phenol-modified terpene resins. These may be used alone or in combination.

Examples of the polyolefin include low-molecular weight polyethylene, and low-molecular weight polypropylene.

Examples of the olefin copolymers include ethylene/acrylic acid copolymers, ethylene/acrylic acid ester copolymers, styrene/methacrylic acid copolymers, ethylene/methacrylic acid ester copolymers, ethylene/vinyl chloride copolymers, ethylene/vinyl acetate copolymers, and ionomer resins.

The colorant (pigment or dye) is not particularly limited; and examples thereof include a yellow pigment, orange pigment, red pigment, violet pigment, blue pigment, green pigment, black pigment, and azine pigment. These may be used alone or in combination.

Examples of the yellow pigment include cadmium yellow, mineral fast yellow, nickel titanium yellow, navel's yellow, naphthol yellow S, Hansa yellow G, Hansa yellow 10G, Hansa yellow G, benzidine yellow GR, quinoline yellow lake, permanent yellow NCG, and tartrazine lake.

Examples of the orange pigment include molybdenum orange, permanent orange GTR, pyrazolone orange, vulcan orange, indanthrene brilliant orange RK, benzidine orange, and indanthrene brilliant orange GK.

Examples of the red pigment include colcothar, cadmium red, permanent red 4R, lithol red, pyrazolone red, watching red calcium salt, lake red D, brilliant carmine 6B, eosin lake, rhodamine lake B, alizarine lake, and brilliant carmine 3B.

Examples of the violet pigment include fast violet B, and methyl violet lake.

Examples of the blue pigment include cobalt blue, alkali blue, Victoria blue lake, phthalocyanine blue, metal-free phthalocyanine blue, phthalocyanine blue partial chloride, fast sky blue, and indanthrene blue BC.

Examples of the green pigment include chromium green, chromium oxide, pigment green B, and malachite green lake.

Examples of the azine-based pigment include carbon black, oil furnace black, channel black, lamp black, acetylene black, and aniline black.

Examples of the black pigment include metal salt azo pigment, metal oxide, and composite metal oxide.

The releasing agent is not particularly limited; and examples thereof include polyolefins such as polyethylene, and polypropylene, fatty acid metal salts, fatty acid esters, paraffin waxes, amide waxes, polyalcohol waxes, silicone vanishes, carnauba waxes, and ester waxes. These may be used alone or in combination.

Furthermore, the toner may further contain a charge control agent. The charge control agent is not particularly limited; examples thereof include nigrosine; azine-based dyes with an alkyl group having 2 to 16 carbon atoms (see Japanese Patent Application Publication (JP-B) No. 42-1627); basic dyes such as C. I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040), and C. I. Basic Green 4 (C. I. 42000); lake pigments of these basic dyes; quaternary ammonium salts such as C. I. Solvent Black 8 (C. I. 26150), benzoyl methyl hexadecyl ammonium chloride, and decyltrimethyl ammonium chloride; dialkyl tin compounds such as dibutyltin compound, and dioctyltin compound; dialkyltin borate compounds; guanidine derivatives; polyamine resins such as vinyl polymers having an amino group, and condensation polymers having an amino group; metal complex salts of monoazo dyes described in JP-B No. 41-20153, JP-B No. 43-27596, JP-B No. 44-6397, JP-B No. 45-26478; salicylic acid described in JP-B No. 55-42752, and JP-B No. 59-7385; metal complexes composed of an acid such as dialkylsalicylic acid, naphthoic acid, and dicarboxylic, and a metal such as Zn, Al, Co, Cr, and Fe; sulfonated copper phthalocyanine pigments; organoboron salts; fluorine-containing quaternary ammonium salts; and calixarene compounds. These may be used in combination. Note that for toners having colors other than black, metal salts of white salicylic acid derivatives are preferably used.

The external additives are not particularly limited; and examples thereof include inorganic particles, and resin particles. These may be used alone or in combination.

Examples of the inorganic particles include silica, titanium oxide, alumina, silicon carbide, silicon nitride, and boron nitride.

Examples of the resin particles include polymethylmethacrylate particles and polystyrene particles either of which is obtained by a soap-free emulsion polymerization and have an average particle diameter of 0.05 μm to 1 μm.

Among these, metal oxide particles (such as silica and titanium oxide) surfaces of which have undergone a hydrophobizing treatment are preferable. When the hydrophobized silica and the hydrophobized titanium oxide are used in combination in a toner such that the amount of the hydrophobized titanium oxide added is more than the amount of the hydrophobized silica added, the toner excellent in charging stability over a wide range of humidity can be obtained.

(Image Forming Method, Process Cartridge)

An image forming method according to the present invention, includes at least forming a latent electrostatic image on a latent electrostatic image bearing member, developing the latent electrostatic image formed on the latent electrostatic image bearing member with the developer according to the present invention to form a toner image, transferring the toner image formed on the latent electrostatic image bearing member to a recording medium, and fixing the toner image transferred onto the recording medium.

Figure 2:
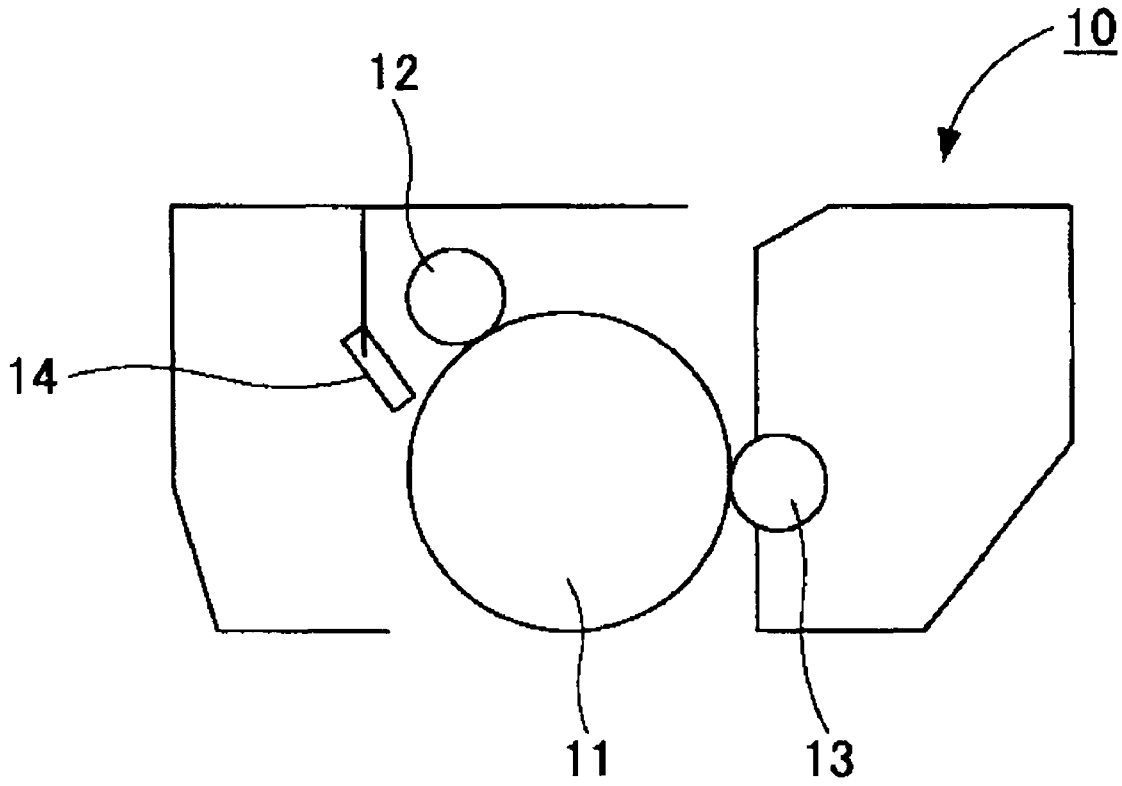
FIG. 2 is a view of an example of a process cartridge of the present invention.

An example of a process cartridge according to the present invention is shown in FIG. 2. On the process cartridge 10, at least a photoconductor 11, a charging unit 12 configured to charge the photoconductor 11, a developing unit 13 configured to develop the latent electrostatic image formed on the photoconductor 11 with the developer of the present invention to form the toner image, and a cleaning unit 14 configured to remove the residual toner remained on the photoconductor 11 after the toner image formed on the photoconductor 11 has been transferred to a recording medium, are mounted in an integrated manner, wherein the process cartridge 10 is detachable from the body of an image forming apparatus such as copier and printer.

Hereinafter, a process for forming an image using the image forming apparatus equipped with the process cartridge 10 will be described. First, the photoconductor 11 is driven to rotate at a predetermined circumferential velocity, and the circumferential surface of the photoconductor 11 is uniformly charged with the charging unit 12 such that the surface of the photoconductor has positive or negative predetermined potential. Subsequently, the circumferential surface of the photoconductor 11 is exposed to an exposing light emitted from an exposing unit (not shown) such as those configured to expose a latent electrostatic image to a light from a slit and those configured to scan-expose the latent electrostatic image to a laser beam, and thereby the latent electrostatic image is sequentially formed. Furthermore, the latent electrostatic image formed on the circumferential surface of the photoconductor 11 is developed with the developer of the present invention by means of the developing unit 13, and thereby a toner image is formed. Then, the toner image formed on the circumferential surface of the photoconductor 11 is sequentially transferred to transfer paper which has been fed from a paper feeding section (not shown) to a space between the photoconductor 11 and a transfer unit (not shown), while being synchronized with the rotation of the photoconductor 11. Further, the transfer paper on which the toner image has been transferred, is separated from the circumferential surface of the photoconductor 11, and introduced into a fixing unit (not shown) to undergo a fixing treatment, then printed out as a print-out (copy) and fed to outside of the image forming apparatus. Meanwhile, after the toner image has been transferred, the surface of the photoconductor 11 is cleaned with a cleaning unit 14 by removal of residual toner thereof, and then neutralized with a charge elimination unit (not shown) for subsequent repeated use in image formation.

When the carrier of the present invention is incorporated into a supplemental developer composed of the carrier and a toner, and the supplemental developer is used in an image forming apparatus in which image formation is carried out with replacing an excess developer in the developing unit by the supplemental developer, an image quality stable over a very long period may be obtained. That is, when a carrier which is degraded in the developing unit is replaced by a carrier which is not degraded and contained in the supplemental developer, the charged amount of a developer in the developing unit is stable over a long period, and stable images are obtained. Such a method is effective especially when printing images having large areas. When the images having large areas are printed, the main cause of carrier degradation is degradation of carrier electrification due to toner spent to the carrier, however, when the above method is used at the time of printing images having large areas, a large amount of the supplemental carrier is required for the printing, leading to replacement of the non-degraded carrier contained in the supplemental developer with the degraded carrier at a high rate. As a result, stable images are obtained over a very long period. A mixing ratio of the toner and the carrier (the supplemental carrier) in the supplemental developer is preferably 2 parts by mass to 50 parts by mass of the toner to 1 part by mass of the carrier.

When the mixing ratio of the toner to the carrier (supplemental carrier) in the supplemental developer is less than 2 parts by mass, the rate of the supplemental carrier relative to the toner is excessively high so that the concentration of a total carrier in a developer in the developing unit becomes excessively high due to the supply of the excessive amount of the supplemental carrier to the developer in the developing unit, leading to easy increase in the charged amount of the developer in the developing unit. In addition, in this case the charged amount of the developer in the developing unit is increased so that developing ability and thus image density may be degraded. When the mixing ratio of the toner to the supplemental carrier in the supplemental developer is more than 50 parts by mass, the amount of the supplemental carrier in the supplemental developer becomes small, and thereby the rate of replacement of the total carrier in the developer of the developing unit with the supplemental carrier is reduced in an image forming apparatus, making less likely effective prevention of carrier degradation by the making up.

EXAMPLES

Hereinafter, the present invention will be further described specifically, referring to the following Examples and Comparative Examples, which, however, shall not be construed as limiting the scope of the present invention. Note that "part(s)" means "part(s) by mass".

Example 1

<Production of Carrier>

A silicone resin (SR2406, manufactured by Dow Corning Toray Co., Ltd.) having a solid content of 50% by mass (200 parts) was dispersed in 1,000 parts of toluene by 10-min dispersion using a homo mixer. Subsequently, 2 parts of titanium diisopropoxy bis(ethylaceto-acetate) (TC-750, manufactured by Matsumoto Fine Chemical Co., Ltd) were added to the resulting dispersion, and the resulting mix was stirred for 30 sec to prepare a covering layer application liquid.

Note that the silicone resin (SR2406, manufactured by Dow Corning Toray, Co., Ltd.) is a silicone resin having an alkoxysilyl group.

The covering layer application liquid was applied to sintered ferrite powder having a weight average particle diameter of 35 μm using a spira coater with a temperature setting of 50° C. in the coater such that the covering layer had an average thickness of 0.1 μm, and the resulting coated powder was dried, then sintered in an electric furnace at 250° C. for one hour, and cooled, and subsequently the resulting powder was sieved through a sieve having a pore size of 63 μm to prepare a carrier.

Example 2

<Production of Carrier>

A silicone resin (SR2406, manufactured by Dow Corning Toray Co., Ltd.) having a solid content of 50% by mass (200 parts), 10 parts of a carbon black (Black Porls 2000, manufactured by Cabot Specialty Chemicals Inc.), and 10 parts of aminosilane (SH6020, manufactured by Dow Corning Toray Co., Ltd.) were dispersed in 1,000 parts of toluene by 10-min dispersion using a homo mixer. Subsequently, 2 parts of titanium diisopropoxy bis(ethylaceto-acetate) (TC-750, manufactured by Matsumoto Fine Chemical Co., Ltd) were added to the resulting dispersion, and the resulting mix was stirred for 30 sec to prepare a covering layer application liquid.

A carrier of Example 2 was prepared in the same manner as in Example 1, except that the covering layer application liquid thus obtained was applied such that the covering layer had an average thickness of 2.0 μm.

Example 3

<Production of Carrier>

A silicone resin (SR2406, manufactured by Dow Corning Toray Co., Ltd.) having a solid content of 50% by mass (160 parts), 10 parts of aminosilane (SH6020, manufactured by Dow Corning Toray Co., Ltd.), 60 parts of an acrylic resin (My coat 106, MT AquaPolymer, Inc.) having a solid content of 50% by mass, 20 parts of a guanamine resin having a solid content of 50% by mass (Hitaloid 3001, manufactured by Hitachi Chemical Co., Ltd.), and 0.3 parts of an acid catalyst having a solid content of 50% by mass (Catalyst 4040, MT AquaPolymer, Inc.), and 150 parts of a conductive particle (EC-700, manufactured by Titan Kogyo, Ltd.) were dispersed in 1,000 parts of toluene by 10-min dispersion using a homo mixer. Subsequently, 2 parts of titanium diisopropoxy bis (ethylaceto-acetate) (TC-750, manufactured by Matsumoto Fine Chemical Co., Ltd) were added to the resulting dispersion, and the resulting mix was stirred for 30 sec to prepare a covering layer application liquid.

A carrier of Example 3 was prepared in the same manner as in Example 1, except that the covering layer application liquid thus obtained was applied such that the covering layer had an average thickness of 0.3 μm.

Example 4

<Production of Carrier>

A silicone resin (SR2400, manufactured by Dow Corning Toray Co., Ltd.) having a solid content of 50% by mass (140 parts), 30 parts of a crosslinking agent represented by the following general formula (LS5140, manufactured by Shin-Etsu Chemical Co., Ltd.), 10 parts of aminosilane (SH6020, manufactured by Dow Corning Toray Co., Ltd.), and 150 parts of a conductive particle (EC-700, manufactured by Titan Kogyo, Ltd.) were dispersed in 1,000 parts of toluene by 10-min dispersion using a homo mixer. Subsequently, 0.5 parts of titanium diisopropoxy bis(ethylaceto-acetate) (TC-750, manufactured by Matsumoto Fine Chemical Co., Ltd) were added to the resulting dispersion, and the resulting mix was stirred for 30 sec to prepare a covering layer application liquid.

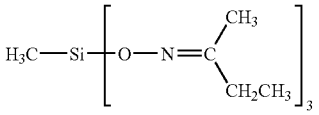

A carrier of Example 4 was prepared in the same manner as in Example 1, except that the covering layer application liquid thus obtained was applied such that the covering layer had an average thickness of 0.3 μm.

Example 5

<Production of Carrier>

A silicone resin (SR2400, manufactured by Dow Corning Toray Co., Ltd.) having a solid content of 50% by mass (140 parts), 30 parts of a crosslinking agent (LS5140, manufactured by Shin-Etsu Chemical Co., Ltd.), 10 parts of aminosilane (SH6020, manufactured by Dow Corning Toray Co., Ltd.), and 150 parts of a conductive particle (EC-700, manufactured by Titan Kogyo, Ltd.) were dispersed in 1,000 parts of toluene by 10-min dispersion using a homo mixer. Subsequently, 10 parts of titanium diisopropoxy bis(ethylaceto-acetate) (TC-750, manufactured by Matsumoto Fine Chemical Co., Ltd) were added to the resulting dispersion, and the resulting mix was stirred for 30 sec to prepare a covering layer application liquid.

A carrier of Example 5 was prepared in the same manner as in Example 1, except that the covering layer application liquid thus obtained was applied such that the covering layer had an average thickness of 0.3 μm.

Example 6

<Production of Carrier>

A silicone resin (SR2400, manufactured by Dow Corning Toray Co., Ltd.) having a solid content of 50% by mass (140 parts), 30 parts of a crosslinking agent (LS5140, manufactured by Shin-Etsu Chemical Co., Ltd.), 10 parts of aminosilane (SH6020, manufactured by Dow Corning Toray Co., Ltd.), and 150 parts of a conductive particle (EC-700, manufactured by Titan Kogyo, Ltd.) were dispersed in 1,000 parts of toluene by 10-min dispersion using a homo mixer. Subsequently, 10 parts of titanium diisopropoxy bis(ethylaceto-acetate) (TC-750, manufactured by Matsumoto Fine Chemical Co., Ltd) were added to the resulting dispersion, and the resulting mix was stirred for 30 sec to prepare a covering layer application liquid.

A carrier of Example 6 was prepared in the same manner as in Example 1, except that the covering layer application liquid thus obtained was applied such that the covering layer had an average thickness of 0.3 μm.

Comparative Example 1

<Production of Carrier>

A carrier of Comparative Example 1 was prepared in the same manner as in Example 1, except that titanium tetraisopropoxide having a solid content of 99% by mass (TA-10, manufactured by Matsumoto Fine Chemical Co., Ltd.) was used instead of titanium diisopropoxy bis (ethylaceto-acetate) (TC-750, manufactured by Matsumoto Fine Chemical Co., Ltd).

Comparative Example 2

<Production of Carrier>

A carrier of Comparative Example 2 was prepared in the same manner as in Example 1, except that 2.7 parts of titanium diisopropoxy bis(acetylacetonate) having a solid content of 75% by mass (TC-100, manufactured by Matsumoto Fine Chemical Co., Ltd.) was used instead of titanium diisopropoxy bis(ethylaceto-acetate) (TC-750, manufactured by Matsumoto Fine Chemical Co., Ltd).

Comparative Example 3

<Production of Carrier>

A carrier of Comparative Example 3 was prepared in the same manner as in Example 1, except that dibutyl tin diacetate (U-200, manufactured by NITTO KASEI KOGYO K. K.) was used instead of titanium diisopropoxy bis(ethylaceto-acetate) (TC-750, manufactured by Matsumoto Fine Chemical Co., Ltd).

Comparative Example 4

<Production of Carrier>

A carrier of Comparative Example 4 was prepared in the same manner as in Example 1, except that dibutyl tin oxide (U-300, manufactured by NITTO KASEI KOGYO K. K.) was used instead of titanium diisopropoxy bis(ethylaceto-acetate) (TC-750, manufactured by Matsumoto Fine Chemical Co., Ltd).

Comparative Example 5

<Production of Carrier>

A carrier of Comparative Example 5 was prepared in the same manner as in Example 2, except that titanium tetraisopropoxide having a solid content of 99% by mass (TA-10, manufactured by Matsumoto Fine Chemical Co., Ltd.) was used instead of titanium diisopropoxy bis (ethylaceto-acetate) (TC-750, manufactured by Matsumoto Fine Chemical Co., Ltd).

Comparative Example 6

<Production of Carrier>

A carrier of Comparative Example 6 was prepared in the same manner as in Example 2, except that dibutyl tin diacetate (U-200, manufactured by NITTO KASEI KOGYO K. K.) was used instead of titanium diisopropoxy bis(ethylaceto-acetate) (TC-750, manufactured by Matsumoto Fine Chemical Co., Ltd).

Comparative Example 7

<Production of Carrier>

A carrier of Comparative Example 7 was prepared in the same manner as in Example 3, except that 2.7 parts of titanium diisopropoxy bis(acetylacetonate) having a solid content of 75% by mass (TC-100, manufactured by Matsumoto Fine Chemical Co., Ltd.) was used instead of titanium diisopropoxy bis(ethylaceto-acetate) (TC-750, manufactured by Matsumoto Fine Chemical Co., Ltd).

Comparative Example 8

<Production of Carrier>

A carrier of Comparative Example 8 was prepared in the same manner as in Example 3, except that 2 parts of dibutyl tin oxide (U-300, manufactured by NITTO KASEI KOGYO K.K.) was used instead of titanium diisopropoxy bis(ethylaceto-acetate) (TC-750, manufactured by Matsumoto Fine Chemical Co., Ltd).

Comparative Example 9

<Production of Carrier>

A carrier of Comparative Example 9 was prepared in the same manner as in Example 4, except that 10 parts of titanium diisopropoxy bis (acetylacetonate) having a solid content of 75% by mass (TC-100, manufactured by Matsumoto Fine Chemical Co., Ltd.) was used instead of titanium diisopropoxy bis(ethylaceto-acetate) (TC-750, manufactured by Matsumoto Fine Chemical Co., Ltd).

Comparative Example 10

<Production of Carrier>

A carrier of Comparative Example 10 was prepared in the same manner as in Example 4, except that 10 parts of dibutyl tin diacetate (TC-100, manufactured by Matsumoto Fine Chemical Co., Ltd.) was used instead of titanium diisopropoxy bis(ethylaceto-acetate) (TC-750, manufactured by Matsumoto Fine Chemical Co., Ltd).

Materials contained in Examples 1 to 6 and Comparative Examples 1 to 10 are indicated in Tables 1, 2-1, and 2-2.

TABLE 1

| | Solid content | Ex. 1 (parts) | Ex. 2 (parts) | Ex. 3 (parts) | Ex. 4 (parts) | Ex. 5 (parts) | Ex. 6 (parts) |
|---|---|---|---|---|---|---|---|
| SR2406[a)] | 50% | 200 | 200 | 160 | | | |
| SR2400[b)] | 50% | | | | 140 | 140 | 140 |
| LS-5140[c)] | 100% | | | | 30 | 30 | 30 |
| TC-750[d)] | 95% | 2 | 2 | 2 | 0.5 | 10 | 20 |
| Black Porls 2000[e)] | 100% | | 10 | | | | |
| SH6020[f)] | 100% | | 10 | 10 | 10 | 10 | 10 |
| Acrylic resin | 50% | | | 60 | | | |
| Guanamine resin | 50% | | | 20 | | | |
| Acid catalyst | 50% | | | 0.3 | | | |
| EC-700[g)] | 100% | | | 150 | 150 | 150 | 150 |
| Toluene | 0% | 1,000 | 1,000 | 1,000 | 1,000 | 1,000 | 1,000 |

[a)b)]Silicone resin manufactured by Dow Corning Toray;
[c)]Crosslinking agent manufactured by Shin-Etsu Chemical;
[d)]Titanium diisopropoxy bis(ethylaceto-acetate), $Ti(O\text{-}i\text{-}C_3H_7)_2(C_6H_9O_3)_2$, manufactured by Matsumoto Fine Chemical;
[e)]Conductive Particle (carbon black) manufactured by Cabot Specialty Chemicals;
[f)]Aminosilane manufactured by Dow Corning Toray;
[g)]Conductive particle by Titan Kogyo.

TABLE 2-1

| | Solid content | Comp. Ex. 1 (parts) | Comp. Ex. 2 (parts) | Comp. Ex. 3 (parts) | Comp. Ex. 4 (parts) | Comp. Ex. 5 (parts) | Comp. Ex. 6 (parts) |
|---|---|---|---|---|---|---|---|
| SR2406[a)] | 50% | 200 | 200 | 200 | 200 | 200 | 200 |
| SR2400[b)] | 50% | | | | | | |
| LS-5140[c)] | 100% | | | | | | |
| TA-10[d)] | 99% | 2 | | | | 2 | |
| TC-100[e)] | 75% | | 2.7 | | | | |
| U-200[f)] | 100% | | | 2 | | | 2 |
| U-300[g)] | 100% | | | | 2 | | |
| Black Porls 2000[h)] | 100% | | | | | 10 | 10 |
| SH6020[i)] | 100% | | | | | 10 | 10 |
| Acrylic resin | 50% | | | | | | |
| Guanamine resin | 50% | | | | | | |
| Acid catalyst | 50% | | | | | | |
| EC-700[j)] | 100% | | | | | | |
| Toluene | 0% | 1,000 | 1,000 | 1,000 | 1,000 | 1,000 | 1,000 |

[a)b)]Silicone resin manufactured by Dow Corning Toray;
[c)]Crosslinking agent manufactured by Shin-Etsu Chemical;
[d)]Titanium tetraisopropoxide $Ti(O\text{-}i\text{-}C_3H_7)_4$, manufactured by Matsumoto Fine Chemical;
[e)]Titanium diisopropoxy bis(acetylacetonate), $Ti(O\text{-}i\text{-}C_3H_7)_2(C_5H_7O_2)_2$, manufactured by Matsumoto Fine Chemical;
[f)]Dibutyl tin diacetate, $(C_4H_9)_2Sn(OCOCH_3)_2$, manufactured by NITTO KASEI KOGYO K.K.;
[g)]Dibutyl tin oxide, $(C_4H_9)_2SnO$, manufactured by NITTO KASEI KOGYO K.K;
[h)]Conductive Particle (carbon black) manufactured by Cabot Specialty Chemicals;
[i)]Aminosilane manufactured by Dow Corning Toray; and
[j)]Conductive particle manufactured by Titan Kogyo.

TABLE 2-2

| | Solid content | Comp. Ex. 7 (parts) | Comp. Ex. 8 (parts) | Comp. Ex. 9 (parts) | Comp. Ex. 10 (parts) |
|---|---|---|---|---|---|
| SR2406[a)] | 50% | 160 | 160 | | |
| SR2400[b)] | 50% | | | 140 | 140 |
| LS-5140[c)] | 100% | | | 30 | 30 |
| TA-10[d)] | 99% | | | | |
| TC-100[e)] | 75% | 2.7 | | 10 | |
| U-200[f)] | 100% | | | | 10 |
| U-300[g)] | 100% | | 2 | | |
| Black Porls 2000[h)] | 100% | | | | |
| SH6020[i)] | 100% | 10 | 10 | 10 | 10 |
| Acrylic resin | 50% | 60 | 60 | | |
| Guanamine resin | 50% | 20 | 20 | | |
| Acid catalyst | 50% | 0.3 | 0.3 | | |
| EC-700[j)] | 100% | 150 | 150 | 150 | 150 |
| Toluene | 0% | 1,000 | 1,000 | 1,000 | 1,000 |

[a)b)]Silicone resin manufactured by Dow Corning Toray;
[c)]Crosslinking agent manufactured by Shin-Etsu Chemical;
[d)]Titanium tetraisopropoxide $Ti(O\text{-}i\text{-}C_3H_7)_4$, manufactured by Matsumoto Fine Chemical;
[e)]Titanium diisopropoxy bis(acetylacetonate), $Ti(O\text{-}i\text{-}C_3H_7)_2(C_5H_7O_2)_2$, manufactured by Matsumoto Fine Chemical;
[f)]Dibutyl tin diacetate, $(C_4H_9)_2Sn(OCOCH_3)_2$, manufactured by NITTO KASEI KOGYO K.K.;
[g)]Dibutyl tin oxide, $(C_4H_9)_2SnO$, manufactured by NITTO KASEI KOGYO K.K;
[h)]Conductive Particle (carbon black) manufactured by Cabot Specialty Chemicals;
[i)]Aminosilane manufactured by Dow Corning Toray; and
[j)]Conductive particle manufactured by Titan Kogyo.

(Evaluation)

The specific volume resistance, magnetization in a magnetic field of 1 kOe, average thickness of the covering layer, and weight average particle diameter of the core material particles were measured for the carriers of Examples 1 to 6 and Comparative Examples 1 to 10 in the following manner. Results are shown in Table 3.

<Specific Volume Resistance>

The specific volume resistance was measured using a cell exhibited in FIG. 1. Specifically, a procedure for the measurement was as follows: a cell composed of a fluorine resin container (2) containing a first electrode (1*a*) and a second electrode (1*b*) each having a surface area of 2.5 cm×4 cm and separated by a distance of 0.2 cm was charged with a carrier (3), and then the cell charged with the carrier was tapped on a substrate ten times from a falling height of 1 cm at a tapping rate of 30 times/min. Subsequently, a DC voltage of 1,000 V was applied between the first electrode (1*a*) and the second electrode (1*b*), and 30 sec after the voltage application, the resistance r [Ω] was measured using a HIGH RESISTANCE METER 4329A (manufactured by Yokogawa Hewlett-Packard), and based on the resistance value the specific volume resistance [Ω·cm] was calculated in accordance with the following formula.

$$r\times(2.5\times4)/0.2$$

<Magnetization in a Magnetic Field of 1 kOe>

After a cell having an internal diameter of 2.4 mm and a height of 8.5 mm was charged with about 0.15 g of a carrier, the magnetization of the carrier in a magnetic field of 1 kOe was measured using VSM-P7-15 (manufactured by TOEI INDUSTRY Co., Ltd.).

<Average Thickness of Covering Layer>

Cross-sections of carrier particles were observed using a transmission electron microscope (TEM) and the average thickness (film thickness) of the covering layers was determined.

<Weight Average Particle Diameter of Core Material Particles>

The particle size distribution of the core material particles were measured using Microtrac Particle Size Analyzer (Model HRA9320-X100, manufactured by NIKKISO CO., Ltd).

TABLE 3

| | Ex. 1 | Ex. 2 | Ex. 3 | Ex. 4 | Ex. 5 | Ex. 6 |
|---|---|---|---|---|---|---|
| Specific volume resistance [Ω · cm] | $1.8\times10^{16}$ | $7.0\times10^{13}$ | $8.8\times10^{11}$ | $8.3\times10^{11}$ | $9.2\times10^{11}$ | $9.5\times10^{11}$ |
| Magnetization (1 kOe) [$Am^2$/kg] | 71 | 71 | 71 | 71 | 71 | 71 |
| Film thickness | 0.1 μm | 2.0 μm | 0.3 μm | 0.3 μm | 0.3 μm | 0.3 μm |
| Weight average particle diameter (μm) | 35 | 35 | 35 | 35 | 35 | 35 |

| | Comp. Ex. 1 | Comp. Ex. 2 | Comp. Ex. 3 | Comp. Ex. 4 | Comp. Ex. 5 | Comp. Ex. 6 |
|---|---|---|---|---|---|---|
| Specific volume resistance [Ω · cm] | $2.2\times10^{16}$ | $2.0\times10^{16}$ | $2.6\times10^{16}$ | $2.4\times10^{16}$ | $6.9\times10^{13}$ | $7.2\times10^{13}$ |
| Magnetization (1 kOe) [$Am^2$/kg] | 71 | 71 | 71 | 71 | 71 | 71 |
| Film thickness | 0.1 μm | 0.1 μm | 0.1 μm | 0.1 μm | 2.0 μm | 2.0 μm |
| Weight average particle diameter (μm) | 35 | 35 | 35 | 35 | 35 | 35 |

| | Comp. Ex. 7 | Comp. Ex. 8 | Comp. Ex. 9 | Comp. Ex. 10 |
|---|---|---|---|---|
| Specific volume resistance [Ω · cm] | $8.8\times10^{11}$ | $9.1\times10^{11}$ | $8.5\times10^{11}$ | $8.0\times10^{11}$ |
| Magnetization (1 kOe) [$Am^2$/kg] | 71 | 71 | 71 | 71 |
| Film thickness | 0.3 μm | 0.3 μm | 0.3 μm | 0.3 μm |
| Weight average particle diameter (μm) | 35 | 35 | 35 | 35 |

Blocking degree of carriers of Examples 1 to 6 and Comparative examples 1 to 10 after sintering the carriers were evaluated as follows. The results are shown in Table 4.

<Blocking Degree of Carriers after Sintering>

The covering layer application liquid was applied to sintered ferrite powder and the resulting coated powder was dried, and the dried coated powder was sintered in an electric furnace at 250° C. for 1 hr and cooled, and then the blocking degree of the carriers are evaluated. Evaluation criteria are as follows.

[Evaluation Criteria]

A: No blocking observed

B: Carriers are binding, but the blocked mass easily degrades

C: Carriers are binding, but the blocked mass easily disintegrates when sieved and the sieve is shaken D: Carriers are binding, but the blocked mass does not disintegrate even when sieved and the sieve is shaken

TABLE 4

| | Ex. 1 | Ex. 2 | Ex. 3 | Ex. 4 | Ex. 5 | Ex. 6 |
|---|---|---|---|---|---|---|
| Blocking degree after sintering | B | B | A | B | A | A |
| | Comp. Ex. 1 | Comp. Ex. 2 | Comp. Ex. 3 | Comp. Ex. 4 | Comp. Ex. 5 | Comp. Ex. 6 |
| Blocking degree after sintering | D | D | B | C | D | B |
| | Comp. Ex. 7 | Comp. Ex. 8 | Comp. Ex. 9 | Comp. Ex. 10 | | |
| Blocking degree after sintering | D | C | C | D | | |

Degree of blocking:

A: carriers not binding

B: carriers binding, but the binding mass easily degrades into a loose mass.

C: carriers binding, but the binding mass can be disintegrated by sieving with a 63-μm mesh sieve and shaking the sieve.

D: carriers binding and cannot be disintegrated by sieving with a 63-μm mesh sieve and shaking the sieve As shown in Table 4, carriers of Examples 1 to 6 and Comparative Examples 3 and 6 had high productivity because of less occurrence of blocking during a sintering process of these carriers. This is because the silicone resins of these carriers have undergone the condensation reaction to adequate degree during a period in which a covering layer application liquid was applied to the sintered ferrite powder and the resulting coated powder was dried, the adequate condensation of the silicone resins resulting in prevention of binding of neighboring silicone resins coating respective sintered ferrite particles when the ferrite powder was sintered.

<Durability of Carrier>

Evaluation of images was performed using a digital full-color copier (IMGIO NEO C600, manufactured by Ricoh Company, Ltd.). Specifically, a carrier of each of Examples 1 to 6 and Comparative Examples 1 to 10 was mixed with each of four toners having different colors, that is a black toner (IMAGIO toner type 2, black), a yellow toner (IMGIO toner type 2, yellow), a magenta toner (IMAGIO toner type 2, magenta), or a cyan toner (IMAGIO toner type 2, cyan) which is used in IMAGIO NEO C600, in a mass ratio of the carrier to the toner of 93:7, and thereby four developers each having a different color were prepared. Subsequently, an image was printed on a recording medium using each developer having a different color at an image area rate of 20% and the carrier was sampled, and the charged amount of the carrier and the specific volume resistance of the carrier were measured in the early period of and after the printing of 100,000 media, thereby the durability of the carrier was evaluated by calculating the amount of decrease in the charged amount and change in the specific volume resistance.

Note that the charged amount of the carrier in the early period of printing was determined by subjecting a sample to a blow-off powder charge amount measuring instrument (TB-200, manufactured by Toshiba Chemical Co., Ltd.), wherein the sample had been prepared by mixing the carrier with the black toner in a mass ratio of 93:7 and had been charged by friction. The charged amount of the carrier after printing was measured in the same manner as above, except that the carrier was used which had been prepared after printing by removing the toner of each color from the developer using the blow-off powder charge amount measurement instrument. Note that a target value of the amount of change in the charged amount was 10 μC/g or less.

On the other hand, the specific volume resistance of a carrier in the early period was expressed as a common logarithmic value of the specific volume resistance of the carrier which was measured in the same manner as above. The specific volume resistance of the carrier after printing was also measured in the same manner as above, except that the carrier was used which had been prepared after printing by removing a toner having each color from a developer using the blow-off powder charge amount measurement instrument. Note that a target value of the specific volume resistance was 1.5 [Log (Ω·cm)] or less.

TABLE 5-1

| | | Ex. 1 | Ex. 2 | Ex. 3 | Ex. 4 | Ex. 5 | Ex. 6 | Comp. Ex. 1 | Comp. Ex. 2 |
|---|---|---|---|---|---|---|---|---|---|
| Black | Q1* | 42 | 34 | 33 | 41 | 38 | 35 | 39 | 37 |
| | Q2* | 37 | 31 | 29 | 36 | 36 | 32 | 20 | 21 |
| | (Q1 − Q2)* | 5 | 3 | 4 | 5 | 2 | 3 | 19 | 16 |
| Yellow | Q1* | 42 | 35 | 33 | 43 | 39 | 36 | 39 | 37 |
| | Q2* | 38 | 32 | 29 | 38 | 36 | 34 | 20 | 21 |
| | (Q1 − Q2)* | 4 | 3 | 4 | 5 | 3 | 2 | 19 | 16 |
| Magenta | Q1* | 43 | 34 | 34 | 42 | 40 | 35 | 39 | 37 |
| | Q2* | 38 | 32 | 30 | 37 | 37 | 30 | 20 | 21 |
| | (Q1 − Q2)* | 5 | 2 | 4 | 5 | 3 | 5 | 19 | 16 |

TABLE 5-1-continued

| | | Ex. 1 | Ex. 2 | Ex. 3 | Ex. 4 | Ex. 5 | Ex. 6 | Comp. Ex. 1 | Comp. Ex. 2 |
|---|---|---|---|---|---|---|---|---|---|
| Cyan | Q1* | 44 | 35 | 32 | 43 | 37 | 36 | 39 | 37 |
| | Q2* | 39 | 32 | 29 | 38 | 34 | 32 | 20 | 21 |
| | Q1 − Q2* | 5 | 3 | 3 | 5 | 3 | 4 | 19 | 16 |

*Charged amount (μC/g)

TABLE 5-2

| | | Comp. Ex. 3 | Comp. Ex. 4 | Comp. Ex. 5 | Comp. Ex. 6 | Comp. Ex. 7 | Comp. Ex. 8 | Comp. Ex. 9 | Comp. Ex. 10 |
|---|---|---|---|---|---|---|---|---|---|
| Black | Q1* | 41 | 39 | 34 | 33 | 30 | 29 | 35 | 30 |
| | Q2* | 20 | 23 | 17 | 18 | 19 | 15 | 25 | 12 |
| | (Q1 − Q2)* | 21 | 16 | 17 | 15 | 11 | 14 | 10 | 18 |
| Yellow | Q1* | 41 | 39 | 34 | 33 | 30 | 29 | 37 | 31 |
| | Q2* | 23 | 21 | 18 | 16 | 18 | 14 | 28 | 10 |
| | (Q1 − Q2)* | 18 | 18 | 16 | 17 | 12 | 15 | 9 | 21 |
| Magenta | Q1* | 41 | 39 | 34 | 33 | 30 | 29 | 33 | 32 |
| | Q2* | 25 | 20 | 19 | 20 | 18 | 13 | 22 | 12 |
| | (Q1 − Q2)* | 16 | 19 | 15 | 13 | 12 | 16 | 11 | 20 |
| Cyan | Q1* | 41 | 39 | 34 | 33 | 30 | 29 | 36 | 33 |
| | Q2* | 23 | 24 | 20 | 19 | 17 | 16 | 25 | 15 |
| | (Q1 − Q2)* | 18 | 15 | 14 | 14 | 13 | 13 | 11 | 18 |

*Charged amount (μC/g)

TABLE 5-3

| | | Ex. 1 | Ex. 2 | Ex. 3 | Ex. 4 | Ex. 5 | Ex. 6 | Comp. Ex. 1 | Comp. Ex. 2 |
|---|---|---|---|---|---|---|---|---|---|
| Black | Early res.[a)] | 16.2 | 13.8 | 11.9 | 11.9 | 12.0 | 12.0 | 16.3 | 16.3 |
| | Late res.[b)] | 16.8 | 14.4 | 12.6 | 12.6 | 12.4 | 12.5 | 17.2 | 17.3 |
| | Difference[c)] | −0.6 | −0.6 | −0.7 | −0.7 | −0.4 | −0.5 | −0.9 | −1.0 |
| Yellow | Early res.[a)] | 16.3 | 13.8 | 11.9 | 11.9 | 12.0 | 12.0 | 16.3 | 16.3 |
| | Late res.[b)] | 16.9 | 15.0 | 12.9 | 12.7 | 12.5 | 12.5 | 17.6 | 17.5 |
| | Difference[c)] | −0.6 | −1.2 | −1.0 | −0.8 | −0.5 | −0.5 | −1.3 | −1.2 |
| Magenta | Early res.[a)] | 16.3 | 13.8 | 11.9 | 11.9 | 12.0 | 12.0 | 16.3 | 16.3 |
| | Late res.[b)] | 16.9 | 14.8 | 12.9 | 12.5 | 12.6 | 12.5 | 17.6 | 17.4 |
| | Difference[c)] | −0.6 | −1.0 | −1.0 | −0.6 | −0.6 | −0.5 | −1.3 | −1.1 |
| Cyan | Early res.[a)] | 16.3 | 13.8 | 11.9 | 11.9 | 12.0 | 12.0 | 16.3 | 16.3 |
| | Late res.[b)] | 16.9 | 14.8 | 12.8 | 13.0 | 12.4 | 12.4 | 17.7 | 17.4 |
| | Difference[c)] | −0.6 | −1.0 | −0.9 | −1.1 | −0.4 | −0.4 | −1.4 | −1.1 |

[a)]Earlier resistance ([Log (Ω · cm)]);
[b)]Later resistance (measured after printing of 100,000 sheets) [Log (Ω · cm)];
[c)]Difference between Early res. and Late res.

TABLE 5-4

| | | Comp. Ex. 3 | Comp. Ex. 4 | Comp. Ex. 5 | Comp. Ex. 6 | Comp. Ex. 7 | Comp. Ex. 8 | Comp. Ex. 9 | Comp. Ex. 10 |
|---|---|---|---|---|---|---|---|---|---|
| Black | Early res.[a)] | 16.4 | 16.4 | 13.8 | 13.9 | 11.9 | 12.0 | 11.9 | 11.9 |
| | Late res.[b)] | 17.5 | 17.3 | 15.0 | 14.9 | 12.8 | 13.0 | 12.7 | 13.2 |
| | Difference[c)] | −1.1 | −0.9 | −1.2 | −1.0 | −0.9 | −1.0 | −0.8 | −1.3 |

TABLE 5-4-continued

| | | Comp. Ex. 3 | Comp. Ex. 4 | Comp. Ex. 5 | Comp. Ex. 6 | Comp. Ex. 7 | Comp. Ex. 8 | Comp. Ex. 9 | Comp. Ex. 10 |
|---|---|---|---|---|---|---|---|---|---|
| Yellow | Early res.[a)] | 16.4 | 16.4 | 13.8 | 13.9 | 11.9 | 12.0 | 11.9 | 11.9 |
| | Late res.[b)] | 17.7 | 17.9 | 15.5 | 15.3 | 13.5 | 13.6 | 12.8 | 13.5 |
| | Difference[c)] | −1.3 | −1.5 | −1.7 | −1.4 | −1.6 | −1.6 | −0.9 | −1.6 |
| Magenta | Early res.[a)] | 16.4 | 16.4 | 13.8 | 13.9 | 11.9 | 12.0 | 11.9 | 11.9 |
| | Late res.[b)] | 17.9 | 17.9 | 15.6 | 15.4 | 13.5 | 13.6 | 12.9 | 13.4 |
| | Difference[c)] | −1.5 | −1.5 | −1.8 | −1.5 | −1.6 | −1.6 | −1.0 | −1.5 |
| Cyan | Early res.[a)] | 16.4 | 16.4 | 13.8 | 13.9 | 11.9 | 12.0 | 11.9 | 11.9 |
| | Late res.[b)] | 17.5 | 18.0 | 15.6 | 15.5 | 13.7 | 13.7 | 12.7 | 13.6 |
| | Difference[c)] | −1.1 | −1.6 | −1.8 | −1.6 | −1.8 | −1.7 | −0.8 | −1.7 |

[a)]Earlier resistance ([Log (Ω · cm)]);
[b)]Later resistance (measured after printing of 100,000 sheets) [Log (Ω · cm)];
[c)]Difference between Early res. and Late res.

As shown in Tables 5-1, 5-2, 5-3, and 5-4, the amount of decrease in the charged amount and the amount of change in the specific volume resistance of the carriers of the Examples were smaller than those of carriers of the Comparative Examples, therefore the carriers of the Examples are likely to avoid toner filming and are excellent in durability.

Example 7

<Amount of Decrease in Charged Amount and Amount of Change in Specific Volume Resistance>

Furthermore, a developing unit of the digital full-color copier (IMAGIO NEO C600, manufactured by Ricoh Company, Ltd.) was remodeled such that the developing unit had a mechanism configured to discharge an excess amount of the developer when a developer was supplied. A carrier of Example 1 was mixed with each of four toners having different colors, that is a black toner (IMGIO toner type 2, black), a yellow toner (IMAGIO toner type 2, yellow), a magenta toner (IMAGIO toner type 2 magenta), or a cyan toner (IMAGIO toner type 2, cyan) which is used in IMAGIO NEO C600, in a mass ratio of the carrier to the toner of 1:20, and thereby a supplemental developer was produced. The charged amount and the specific volume resistance of the carrier were measured in the early period of and after the printing of 100,000 sheets at an image area rate of 20% in the same manner as in durability test, and thereby the amount of decrease in the charged amount and the amount of change in the specific volume resistance were calculated. Results are shown in Table 6.

TABLE 6

| | | Ex. 7 |
|---|---|---|
| Black | Q1* | 42 |
| | Q2* | 41 |
| | (Q1 − Q2)* | 1 |
| Yellow | Q1* | 42 |
| | Q2* | 40 |
| | (Q1 − Q2)* | 2 |
| Magenta | Q1* | 43 |
| | Q2* | 40 |
| | Q1 − Q2* | 3 |
| Cyan | Q1* | 44 |
| | Q2* | 43 |
| | (Q1 − Q2)* | 1 |

TABLE 6-continued

| | | Ex. 7 |
|---|---|---|
| Black | Early res. a) | 16.2 |
| | Late res. b) | 16.5 |
| | Difference c) | −0.3 |
| Yellow | Early res. a) | 16.3 |
| | Late res. b) | 16.6 |
| | Difference c) | −0.3 |
| Magenta | Early res. a) | 16.3 |
| | Late res. b) | 16.4 |
| | Difference c) | −0.1 |
| Cyan | Early res. a) | 16.3 |
| | Late res. b) | 16.5 |
| | Difference c) | −0.2 |

*Charged amount (μC/g)
a) Earlier resistance [Log (Ω · cm)];
b) Later resistance (measured after printing of 100,000 sheets) [Log (Ω · cm)];
c) Difference of Early res. and Later res.

As shown in Table 6, when the carrier of the present invention is used, the amount of decrease in the charged amount and the amount of change in the specific volume resistance of the carrier may be reduced by the use of the supplemental developer.

What is claimed is:

1. A carrier comprising:

a core material particle, and a covering layer, a surface of the core material particle being covered with the covering layer, wherein the covering layer contains a condensate which is obtained by condensation of a silicone resin having at least one of a silanol group and a functional group which can be converted to the silanol group by hydrolysis, the condensation caused by titanium diisopropoxy bis(ethylaceto-acetate) which is incorporated in the silicone resin.

2. The carrier according to claim 1, wherein the silicone resin is cured by a crosslinking agent represented by the following formula:

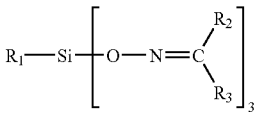

wherein $R_1$, $R_2$, and $R_3$ each represent one of $CH_3$ and $C_2H_5$.

3. The carrier according to claim 1, wherein the amount of titanium diisopropoxy bis(ethylaceto-acetate) is 0.5 parts by mass to 20 parts by mass per 100 parts by mass of the silicone resin and a crosslinking agent.

4. The carrier according to claim 1, wherein the covering layer further contains a conductive particle.

5. The carrier according to claim 1, wherein the covering layer further contains a silane coupling agent.

6. The carrier according to claim 1, wherein the covering layer further contains an acrylic resin.

7. The carrier according to claim 1, wherein the carrier has a specific volume resistance of $1\times10^9$ Ω·cm to $1\times10^{17}$ Ω·cm.

8. The carrier according to claim 1, wherein the covering layer has an average thickness of 0.05 μm to 4 μm.

9. The carrier according to claim 1, wherein the core material particle has a weight average particle diameter of 20 μm to 65 μm.

10. The carrier according to claim 1, wherein the magnetization of the carrier in a magnetic field of 1 kOe is 40 $Am^2/kg$ to 90 $Am^2/kg$.

11. A developer comprising:

the carrier according to claim 1, and a toner.

12. The developer according to claim 11, wherein the toner is a color toner used in polychromatic image formation.

13. An image forming method comprising:

forming a latent electrostatic image on a latent electrostatic image bearing member, developing the latent electrostatic image formed on the latent electrostatic image bearing member with the developer according to claim 11 to form a toner image, transferring the toner image formed on the latent electrostatic image bearing member to a recording medium, and fixing the toner image transferred onto the recording medium.

* * * * *